US006171137B1

(12) United States Patent
Hatakeyama

(10) Patent No.: US 6,171,137 B1
(45) Date of Patent: Jan. 9, 2001

(54) CONNECTOR FOR CONNECTING A FLEXIBLE SUBSTRATE TO CONTACTS

(75) Inventor: Kenichi Hatakeyama, Iwate (JP)

(73) Assignee: NEC Corporation (JP)

( * ) Notice: Under 35 U.S.C. 154(b), the term of this patent shall be extended for 0 days.

(21) Appl. No.: 09/082,370

(22) Filed: May 20, 1998

(30) Foreign Application Priority Data

May 29, 1997 (JP) ..... 9-139987

(51) Int. Cl.[7] ..... H01R 12/24
(52) U.S. Cl. ..... 439/495
(58) Field of Search ..... 439/495

(56) References Cited

U.S. PATENT DOCUMENTS 5,785,549 * 7/1998 Takayasu ..... 439/495

FOREIGN PATENT DOCUMENTS 6-77186 10/1994 (JP) .
677186 10/1994 (JP) .
8-321365 12/1996 (JP) .
9-35828 2/1997 (JP) .
982427 3/1997 (JP) .
9-92411 4/1997 (JP) .
9-97655 4/1997 (JP) .
9-134763 5/1997 (JP) .

* cited by examiner

*Primary Examiner*—Neil Abrams
*Assistant Examiner*—Javaid Nasri
(74) *Attorney, Agent, or Firm*—Hayes, Soloway, Hennessey, Grossman & Hage

(57) ABSTRACT

There is provided a connector for connecting a flexible substrate to a plurality of contacts, including a housing having a first plane on which a flexible substrate is supported and second planes formed at opposite ends of the first plane and having a greater height than the first plane, a plurality of contacts assembled to the housing, and a lever rotatably supported above the housing, the lever being formed with a first outer surface and second outer surfaces formed at opposite ends of the first outer surface. The first outer surface makes contact only with the flexible substrate for compressing the flexible substrate onto the first plane, and the second outer surfaces makes contact only with the second planes for fixing the lever in a stationary position relative to the housing. The above-mentioned connector ensures that a maximum contact force allowable for the flexible substrate can be set at a time when the lever finishes its rotation. Hence, it is possible to fix the flexible substrate in the connector with a maximum contact force.

33 Claims, 11 Drawing Sheets

CONNECTOR FOR CONNECTING A FLEXIBLE SUBSTRATE TO CONTACTS

BACKGROUND OF THE INVENTION

1. Field of the Invention

The invention relates to a connector for fixing a flexible substrate thereon and connecting the flexible substrate to contacts assembled into the connector.

2. Description of the Related Art

Such a connector has been required to be able to connect a flexible substrate to contacts in a higher density, to be formed in a smaller size, and to have higher operability and reliability. For instance, Japanese Unexamined Patent Publication No. 9-82427 and Japanese Unexamined Utility Model Publication No. 6-77186 have suggested a connector for connecting a flexible substrate or flat cable to contacts.

FIGS. 1A to 1C are cross-sectional views of the connector suggested in Japanese Unexamined Patent Publication No. 9-82427, illustrating steps of inserting a flat cable thereto.

The illustrated connector 101 is comprised of a housing 102 which is upwardly open, a plurality of first contacts 103*a* assembled into the housing 102 from a front side (a right side in FIG. 1A) of the housing 102, a plurality of second contacts 103*b* assembled into the housing 102 from a rear side (a left side in FIG. 1A) of the housing 102, and a lever 108 rotatably supported above the housing 102.

As illustrated in FIG. 1A, each of the first contacts 103*a* has an extension 104*a* extending towards the rear side of the housing 102, a contact 106*a* formed on the extension 104*a* in the vicinity of a distal end thereof for making electrical contact with a flat cable 109 (see FIG. 1C), and a lead terminal portion 105*a* extending in an opposite direction to the extension 104*a*. As illustrated in FIG. 1B, each of the second contacts 103*b* has an extension 104*b* extending towards the front side of the housing 102, a contact 106*b* formed on the extension 104*b* at a distal end thereof for making electrical contact with the flat cable 109, a lead terminal portion 105*b* extending in an opposite direction to the extension 104*b*, and a support portion 107*b* extending towards the front side of the housing 102 above the extension 104*b*.

The lever 108 is carried at the support portion 107*b* for rotation. The lever 108 is designed to compress and thus fix the flat cable 109 onto the housing 102 at a certain rotation angle, as illustrated in FIG. 1C. Lines connecting a rotational center 110 of the lever 108 to both the contacts 106*a* and 106*b* make an isosceles triangle.

FIG. 2 illustrates the connector suggested in Japanese Unexamined Utility Model Publication No. 6-77186. The illustrated connector 201 is comprised of a housing 202 which is open upwardly, a plurality of contacts 203, and a lever 210 for compressing and fixing a flexible substrate 209 onto a later mentioned U-shaped contact member 205 of the contacts 203. Each of the contacts 203 has a support portion 204 for supporting the lever 210 for rotation, a U-shaped contact member 205 onto which the flexible substrate 209 is compressed, a contact 208 formed on the U-shaped contact member 205 at a distal end thereof, a lead terminal portion 206 for electrically connecting the flexible substrate 209 to an external element (not illustrated), and an arm portion 207 for connecting the support portion 204, the U-shaped contact member 205, and the lead terminal portion 206 together.

The contacts 203 are assembled into the housing 202 from a rear side (a left side in FIG. 2) of the housing 202. The lever 210 is designed to be rotatable about a tip end of the support portion 204 of the contacts 203. The lever 210 is formed with a raised portion 211, which is situated outside a line connecting a center of the tip end of the support portion 204 to the contact 208 of the contacts 203 when the lever 210 is in a position illustrated in FIG. 2, and situated inside the line when the lever 210 rotates to such a position that the flexible substrate 209 is compressed onto the U-shaped contact member 205 by the lever 210.

FIG. 3A is a graph showing a force exerted when the flat cable 109 is compressed onto the housing 102 by the lever 108 in the connector 101 illustrated in FIGS. 1A to 1C. Now, an angle formed between the lever 108 and the flexible substrate 109 is represented with "θ". FIG. 3A shows a relation between a force F exerted on the flexible substrate 109 by the lever 108 and an angle (90°−θ).

An origin O of the graph shows that the angle θis equal to 90 degrees, that is, the lever 108 stands upright, as illustrated in FIG. 1A. After the lever 108 starts rotation, the lever 108 makes contact with the flexible substrate 109 and begins compressing the flexible substrate 109 onto the housing 102 at the point A. Then, the force F gradually increases as the lever 108 rotates. The force F is maximized at the point B. FIG. 3B illustrates that the lever 108 makes the angle θ with the flexible substrate 109 and exerts the maximum force $F_{max}$ on the flexible substrate 109. Then, the force F gradually decreases as the lever 108 rotates, and finally becomes equal to $F_{end}$ at the point C when the lever 108 finishes rotation, as illustrated in FIG. 3C. A self-locking force S defined as a difference between the forces $F_{max}$ and $F_{end}$ keeps the flexible substrate 109 compressed by the lever 108.

The above-mentioned relation between the force F and the rotation angle θ of the lever 108 is established also in the connector illustrated in FIG. 2.

As mentioned above, the flexible cable 109 is compressed onto the housing 102 with the force F. However, the connector 101 is accompanied with a problem that the force F expected to be as high as possible for fixing the flexible cable 109 cannot be maximized when the lever 108 finishes rotation as illustrated in FIG. 3C. The same problem is paused in the connector 201 illustrated in FIG. 2.

The reason why such a problem is caused is as follows. As illustrated in FIG. 3A, the force F is maximized at the point B when the lever 108 is still rotating, and finally becomes equal to $F_{end}$ which is smaller than $F_{max}$. The conventional connectors 101 and 201 are designed to fix the flexible substrate 109 and 209 with the contact force F, and exert the maximum contact force $F_{max}$ on the flexible substrates 109 and 209 when the levers 108 and 210 are still in rotation. Hence, suppose that a maximum force which the flexible substrate 109 and 209 allow to receive is equal to the maximum contact force $F_{max}$, the force $F_{end}$ obtained when the levers 108 and 210 finish rotation thereof is smaller than the force $F_{max}$. For this reason, the above-mentioned problem is paused.

SUMMARY OF THE INVENTION

It is an object of the present invention to provide a connector which is capable of setting a maximum contact force which a flexible substrate allows to receive, at a time when a lever finishes rotation thereof to thereby fix the flexible substrate onto a housing.

There is provided a connector for connecting a flexible substrate to a plurality of contacts, including (a) a housing into which a flexible substrate is inserted, (b) a plurality of contacts assembled to the housing, and (c) a lever rotatably supported above the housing, the lever being formed with a first outer surface and a second outer surface, the first outer surface making contact only with the flexible substrate for compressing the flexible substrate onto the housing and the second outer surface making contact only with the housing for fixing the lever in a stationary position relative to the housing.

There is further provided a connector for connecting a flexible substrate to a plurality of contacts, including (a) a housing having a first plane on which a flexible substrate is supported and a second plane having a greater height than the first plane, (b) a plurality of contacts assembled to the housing, and (c) a lever rotatably supported above the housing, the lever being formed with a first outer surface and a second outer surface, the first outer surface making contact only with the flexible substrate for compressing the flexible substrate onto the first plane and the second outer surface making contact only with the second plane for fixing the lever in a stationary position relative to the housing.

It is preferable that a difference in height between the first and second planes is set equal to a thickness of the flexible substrate.

In a preferred embodiment, the second outer surface is designed to project outwardly beyond the first outer surface. For instance, the first outer surface may be comprised at least of first and second contact surfaces where the first contact surface makes contact with the flexible substrate while the lever is rotating and the second contact surface makes contact with the flexible substrate when the lever finishes rotating. For instance, the second outer surface may be comprised at least of first and second contact surfaces where the first contact surface makes contact with the second plane while the lever is rotating and the second contact surface makes contact with the second plane when the lever finishes rotating.

There is still further provided a connector for connecting a flexible substrate to a plurality of contacts, including (a) a housing having a first plane on which a flexible substrate is supported and second planes formed at opposite ends of the first plane and having a greater height than the first plane, (b) a plurality of contacts assembled to the housing, and (c) a lever rotatably supported above the housing, the lever being formed with a first outer surface and second outer surfaces formed at opposite ends of the first outer surface, the first outer surface making contact only with the flexible substrate for compressing the flexible substrate onto the first plane and the second outer surfaces making contact only with the second planes for fixing the lever in a stationary position relative to the housing.

There is yet further provided a connector for connecting a flexible substrate to a plurality of contacts, including (a) a housing into which a flexible substrate is inserted, (b) a plurality of contacts assembled to the housing, and (c) a lever rotatably supported above the housing, the lever being formed with a first outer surface and a second outer surface, the first outer surface lying on a common line together with the contacts and a rotational center of the lever, the second outer surface being located outside the common line before the flexible substrate is inserted into the housing, the second outer surface making contact with the housing almost when the second outer surface passes over the common line, the second outer surface being located inside the common line after the flexible substrate is inserted into the housing.

There is still yet further provided a connector for connecting a flexible substrate to a plurality of contacts, including (a) a housing having a first plane on which a flexible substrate is supported, second planes formed at opposite ends of the first plane, and at least one additional second plane located between the second planes, the second planes and the additional second plane all having a greater height than the first plane, (b) a plurality of contacts assembled to the housing, and (c) a lever rotatably supported above the housing, the lever being formed with a first outer surface, second outer surfaces formed at opposite ends of the first outer surface, and at least one additional second outer surface between the second outer surfaces, the first outer surface making contact only with the flexible substrate for compressing the flexible substrate onto the first plane, the second outer surfaces making contact only with the second planes for fixing the lever in a stationary position relative to the housing, and the additional second outer surface making contact only with the additional second plane for fixing the lever in a stationary position relative to the housing.

When the housing includes one additional second plane, it is preferable that it is located at the center between the second planes. As an alternative, when the housing includes two or more additional second planes, it is preferable that they are equally spaced from one another.

The additional second plane is preferably designed to have the same height as that of the second plane. Hence, it is preferable that a difference in height between the first plane and the additional second plane is equal to a thickness of the flexible substrate.

There is still yet further provided a connector for connecting a flexible substrate to a plurality of contacts, including (a) a housing having a first plane on which a flexible substrate is supported and a second plane having a greater height than the first plane, (b) a plurality of contacts assembled to the housing, and (c) a lever rotatably supported above the housing, the lever being formed with a first outer surface and a second outer surface, the first outer surface lying on a common line together with the contacts and a rotational center of the lever, the second outer surface being located outside the common line before the flexible substrate is supported on the first plane, the second outer surface making contact with the second plane almost when the second outer surface passes over the common line, the second outer surface being located inside the common line after the flexible substrate is supported on the first plane.

There is further provided a connector for connecting a flexible substrate to a plurality of contacts, including (a) a housing having a first plane on which a flexible substrate is supported and second planes formed at opposite ends of the first plane and having a greater height than the first plane, (b) a plurality of contacts assembled to the housing, and (c) a lever rotatably supported above the housing, the lever being formed with a first outer surface and second outer surfaces formed at opposite ends of the first outer surface, the first outer surface lying on a common line together with the contacts and a rotational center of the lever, the second outer surface being located outside the common line before the flexible substrate is supported on the first plane, the second outer surface making contact with the second plane almost when the second outer surface passes over the common line, the second outer surface being located inside the common line after the flexible substrate is supported on the first plane.

There is still further provided a connector for connecting a flexible substrate to a plurality of contacts, including (a) a housing having a first plane on which a flexible substrate is supported, second planes formed at opposite ends of the first plane, and at least one additional second plane located between the second planes, the second planes and the additional second plane all having a greater height than the first plane, (b) a plurality of contacts assembled to the housing, and (c) a lever rotatably supported above the housing, the lever being formed with a first outer surface, second outer surfaces formed at opposite ends of the first outer surface, and at least one additional second outer surface between the second outer surfaces, the first outer surface lying on a common line together with the contacts and a rotational center of the lever, the second outer surface and the additional second outer surface being located outside the common line before the lever starts its rotation, the second outer surface making contact with the second plane almost when the second outer surface passes over the common line, the additional second outer surface making contact with the additional second plane almost when the additional second outer surface passes over the common line, the second outer surface and the additional second outer surface being located inside the common line after the flexible substrate is supported on the first plane.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 1A:
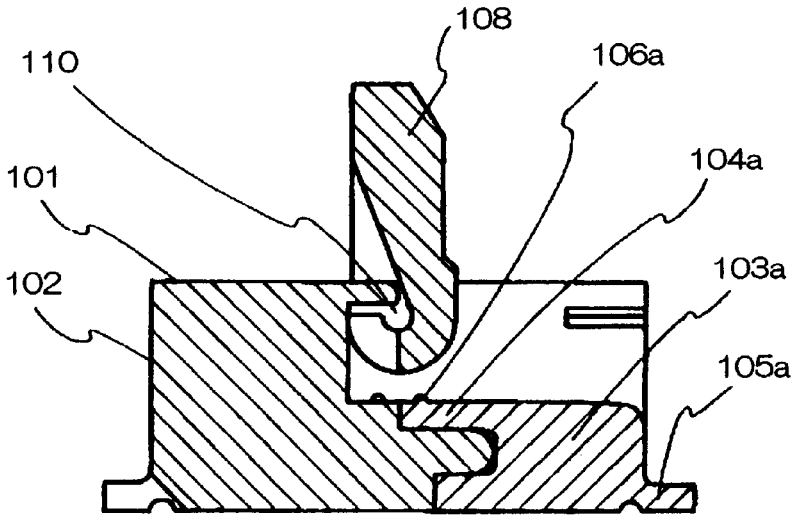
FIG.1A PRIOR ART
FIGS. 1A to 1C are cross-sectional views of a conventional connector, illustrating steps of fixing a flat cable onto a housing.
Figure 1B:
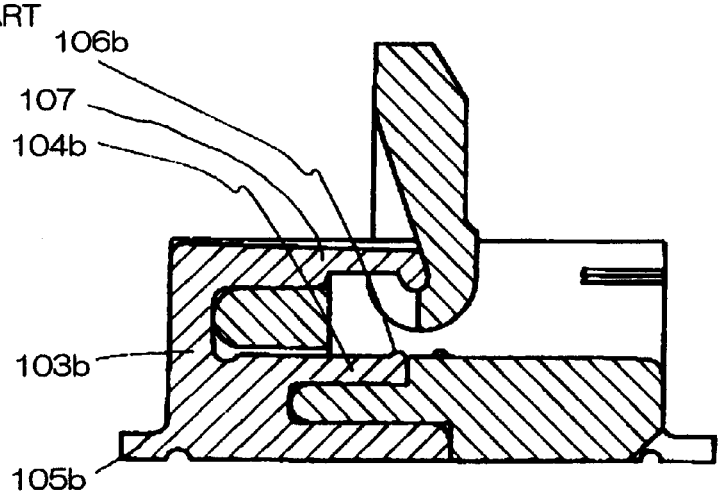
FIG.1B PRIOR ART
Figure 1C:
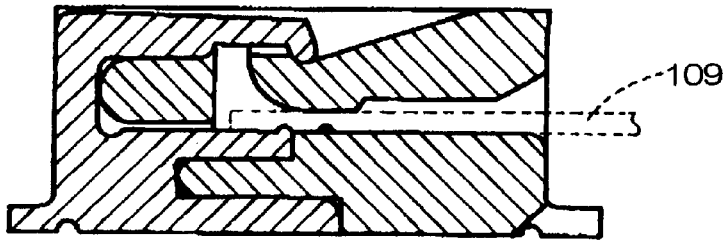
FIG.1C PRIOR ART
Figure 2:
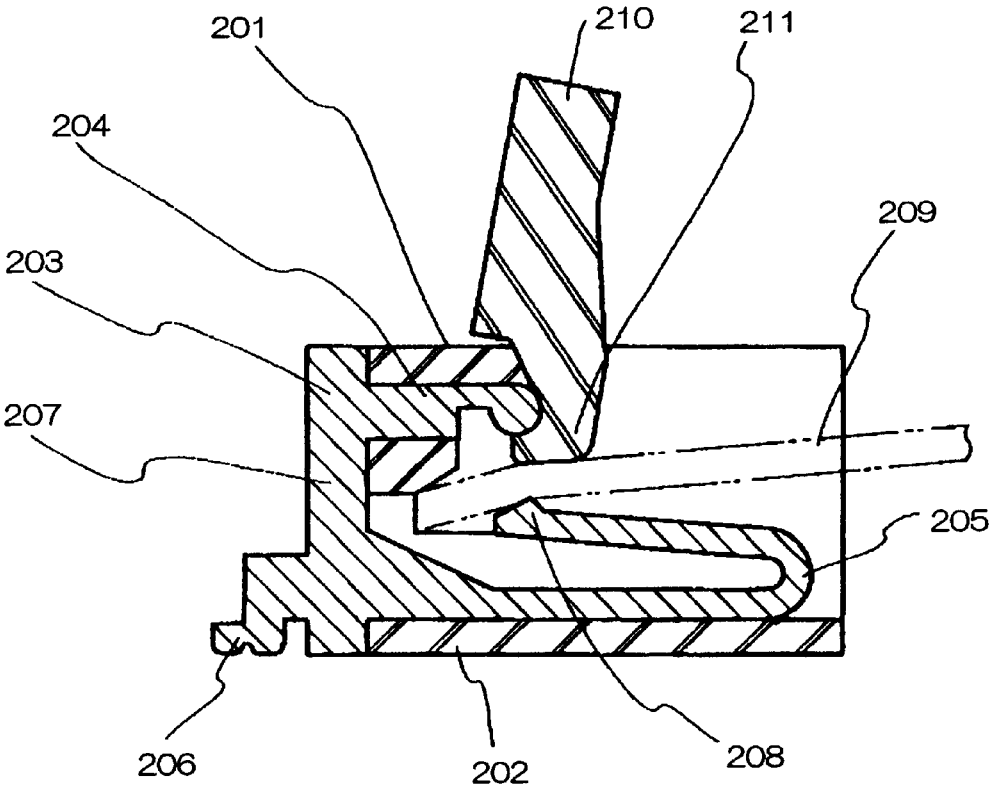
FIG.2 PRIOR ART
FIG. 2 is a cross-sectional view of another conventional connector.
Figure 3B:
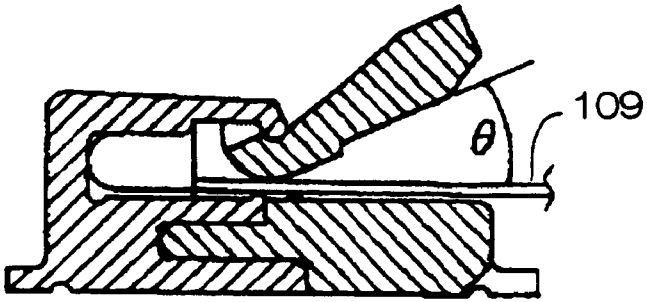
FIG.3B PRIOR ART
FIG. 3B is a cross-sectional view of a conventional connector where a lever is in rotation.
Figure 3C:
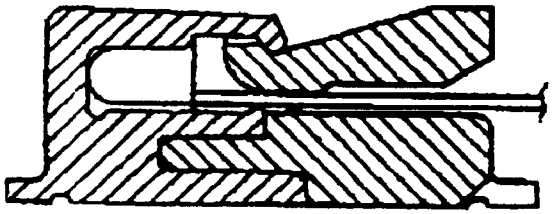
FIG.3C PRIOR ART
FIG. 3C is a cross-sectional view of a conventional connector where a lever finishes rotation thereof and thus compresses a flexible substrate onto a housing.
Figure 3A:
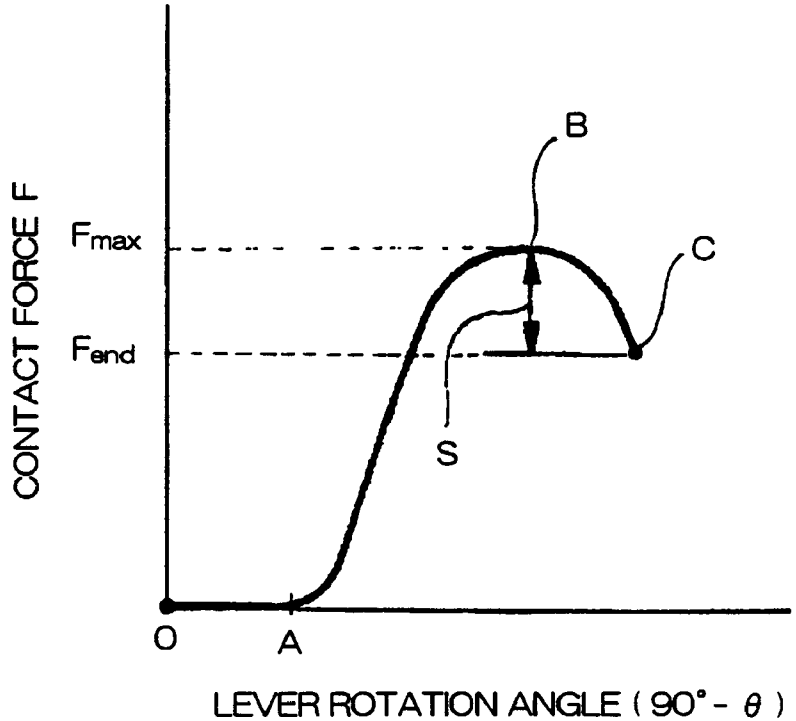
FIG.3A PRIOR ART
FIG. 3A is a graph showing a relation between a contact force and a rotation angle of a lever in a conventional connector.
Figure 4:
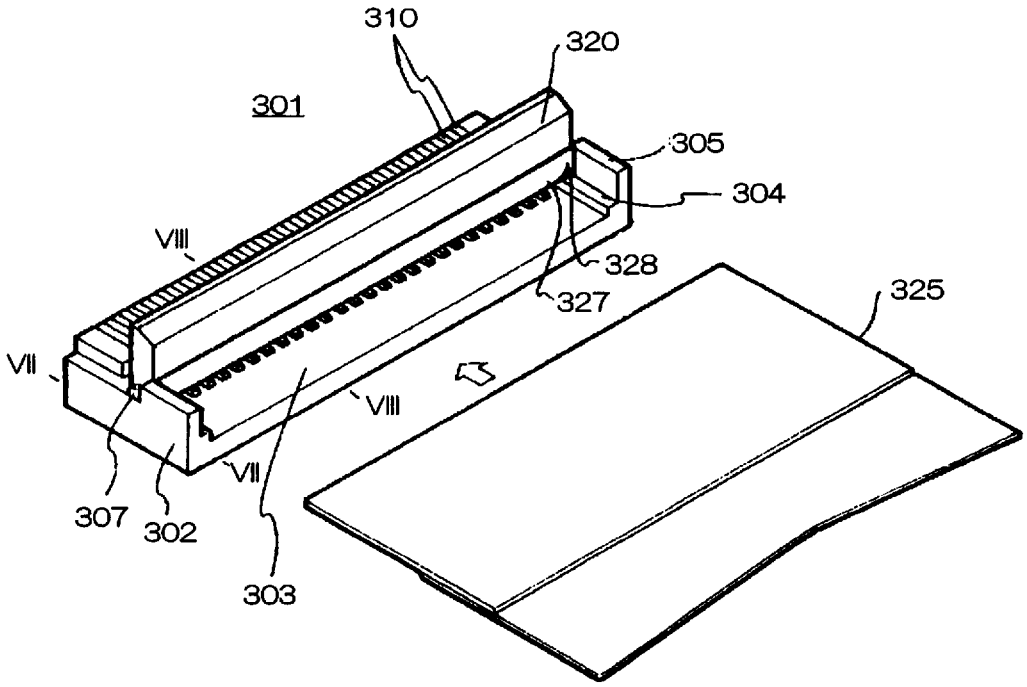
FIG. 4 is a perspective view of a connector in accordance with a referred embodiment of the present invention.

FIG. 4 illustrates a connector in accordance with a preferred embodiment of the present invention.

The illustrated connector 301 is comprised of a housing 302, a plurality of contacts 310, and a lever 320.

As illustrated in FIG. 4, the housing 302 is open upwardly, and includes a first flat plane 303 having a length in a lengthwise direction of the connector 301, second flat planes 304 formed at opposite ends of the first flat plane 303, and sidewalls 305 formed outwardly adjacent to the second flat planes 304. As mentioned later, a flexible substrate 325 is compressed onto the first flat plane 303, and thus fixed in the connector 301.

The second flat planes 304 have a greater height than the first flat plane 303. In this embodiment, a difference in height between the first and second flat planes 303 and 304 is set equal to a thickness of the flexible substrate 325. However, the difference in height may be set greater than a thickness of the flexible substrate 325.

Figure 6:
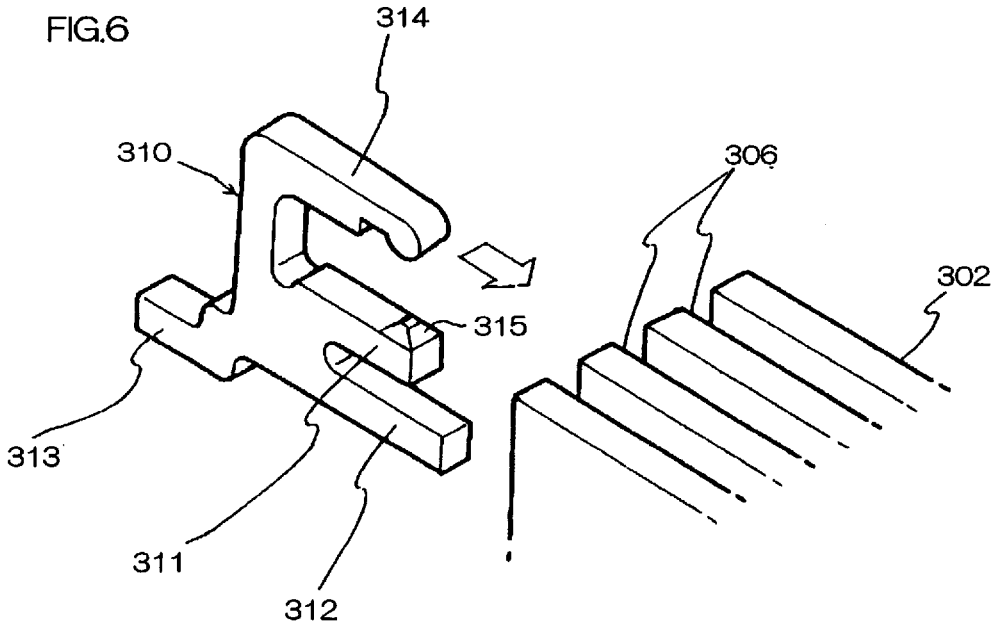
FIG. 6 is a perspective view illustrating a connector to be assembled into a housing.

As illustrated in FIG. 6, the first flat plane 303 of the housing 302 is formed at a rear thereof with a plurality of slits 306. The slits 306 have a common width and length.

In addition, the housing 302 is formed at opposite ends thereof with supports 307 for rotatably supporting the lever 320 therewith.

As illustrated in FIG. 6, each of the contacts 310 is inserted into each of the slits 306. Each of the contacts 310 is designed to have a first extension 311 extending towards a front side of the housing 302, a contact portion 315 formed on the first extension 311 at a distal end thereof for making electrical contact with each of pads 326 (see FIG. 9) formed at a lower surface of the flexible substrate 325, a second extension 312 extending below the first extension 311 towards the front side of the housing 302, a lead terminal portion 313 extending in a direction opposite to a direction in which the first and second extensions 311 and 312 extend, and a support portion 314 extending towards the front side of the housing 302 above the first extension 311.

Figure 8A:
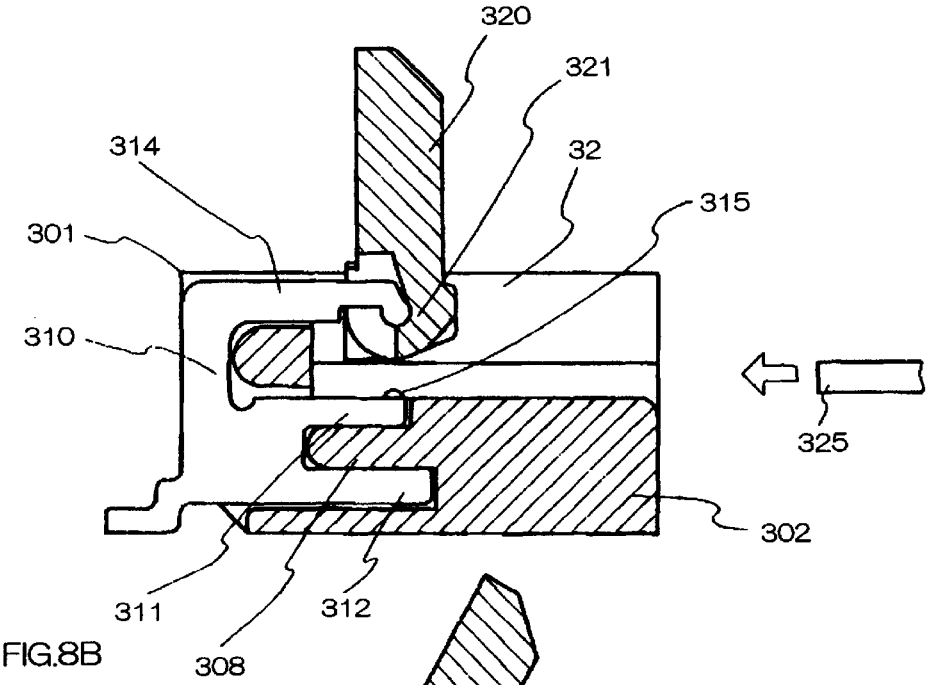
FIGS. 8A to 8C are cross-sectional views of the connector illustrated in FIG. 4, taken along the line VIII—VIII in FIG. 4, illustrating steps of compressing a flexible substrate onto a housing.

As illustrated in FIG. 8A, the housing 302 is formed with a projecting portion 308 towards a rear thereof. When each of the contacts 310 is assembled into the housing 302, the first and second extensions 311 and 312 sandwich the projecting portion 308 therebetween to thereby ensure the contact 310 to be fixed in the housing 302. The support portion 314 is designed to have a distal end having an almost circular cross-section. The lever 320 is rotatably supported by the support portions 314 of the contacts 310.

As illustrated in FIGS. 4 and 8A, the lever 320 is rotatably supported by the supports 307 of the housing 302 and support portions 314 of the contacts 310 above the housing 302. The lever 320 is rotated after the flexible substrate 325 has been set on the first flat plane 303, to thereby compress and fix the flexible substrate 325 onto the contact portions 315 of the contacts 310. After the lever 320 finishes rotation for compressing the flexible substrate 325 onto the contact portions 315, the lever 320 act as a cover for prohibiting dusts from entering the housing 302.

Figure 8B:
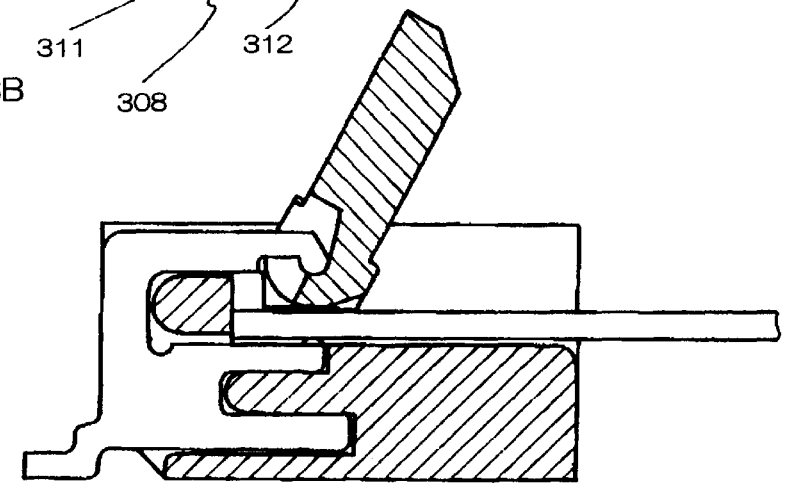
Figure 8C:
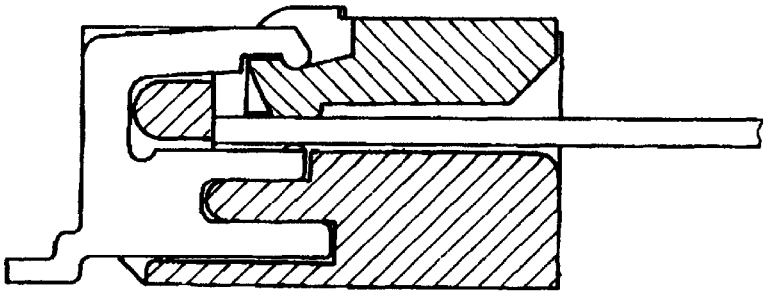

As illustrated in FIGS. 8A to 8C, the lever 320 is formed inside with an engagement portion 321 having an arcuate recess. The distal ends of the support portions 314 of the contacts 310 are fit into the engagement portion 321 of the lever 320 to thereby ensure that the lever 320 is rotatable about the distal end of the support portions 314.

Figure 5:
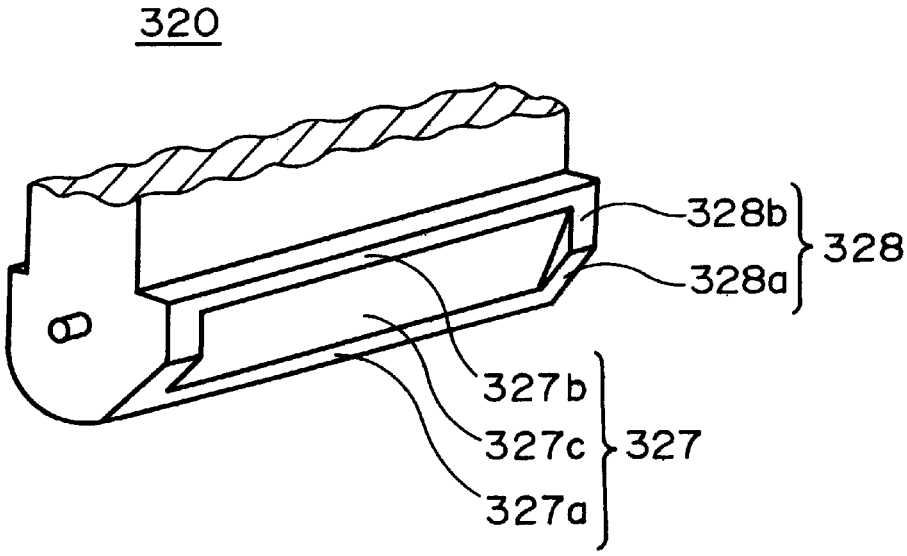
FIG. 5 is a partially enlarged perspective view of a lever.

As illustrated in FIG. 5, the lever 320 is formed in a lengthwise direction thereof with a first outer surface 327 and second outer surfaces 328 formed at opposite ends of the first outer surface 327.

As illustrated in FIGS. 5 and 8A, the first outer surface 327 of the lever 320 is comprised of a first contact surface 327*a*, a second contact surface 327*b*, and a third contact surface 327*c*. The third contact surface 327*c* is sandwiched between the first and second contact surfaces 327*a* and 327*b*. As illustrated in FIG. 8A, the first to third contact surfaces 327*a* to 327*c* do not make contact with the flexible substrate 325 when the flexible substrate 325 is inserted into the housing 302 and the lever 320 is not in rotation, namely, stands upright as illustrated in FIG. 8A. As the lever 320 rotates, the first contact surface 327*a* and then the third contact surface 327*c* make contact with the flexible substrate 325, as illustrated in FIG. 8B. The second contact surface 327*b* makes contact with the flexible substrate 325 when the lever 320 finishes its rotation to thereby compress the flexible substrate 325 onto the first flat plane 303 of the housing 302, as illustrated in FIG. 8C.

Figure 7A:
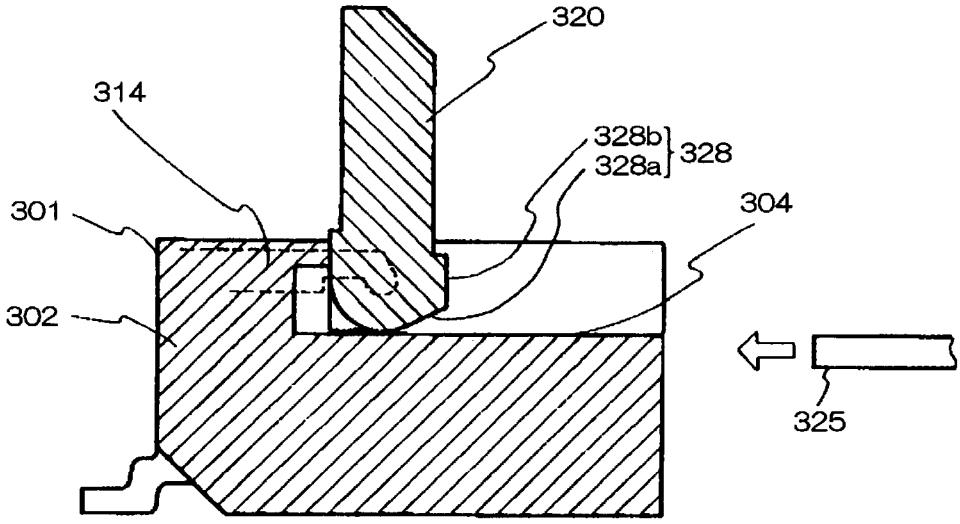
FIGS. 7A to 7C are cross-sectional views of the connector illustrated in FIG. 4, taken along the line VII—VII in FIG. 4, illustrating steps of compressing a flexible substrate onto a housing.

As illustrated in FIGS. 5 and 7A, the second outer surface 328 of the lever 320 is comprised of a first contact surface 328*a* and a second contact surface 328*b*. As illustrated in FIG. 7A, the first contact surface 328*a* makes contact with the second flat plane 304 of the housing 302 while the lever 320 is rotating, and the second contact surface 328*b* makes contact with the second flat plane 304 when the lever 320 finishes its rotation to thereby compress the flexible substrate 325 onto the first flat plane 303 of the housing 302, as illustrated in FIG. 7C.

As best illustrated in FIG. 5, the second outer surface 328 wholly projects outwardly beyond the first outer surface 327. The first outer surface 327 of the lever 320 has the same length as a length of the first flat plane 303 of the housing 302, and the second outer surface 328 of the lever 320 has the same length as a length of the second flat plane 304. Hence, the first outer surface 327 makes contact only with the flexible substrate 325 for compressing the flexible substrate 325 onto the first flat plane 303 while the lever 320 is rotating, as illustrated in FIGS. 8A to 8C. The second outer surface 328 makes contact only with the second flat plane 304 for fixing the lever 320 in a stationary position relative to the housing 302.

Figure 9:
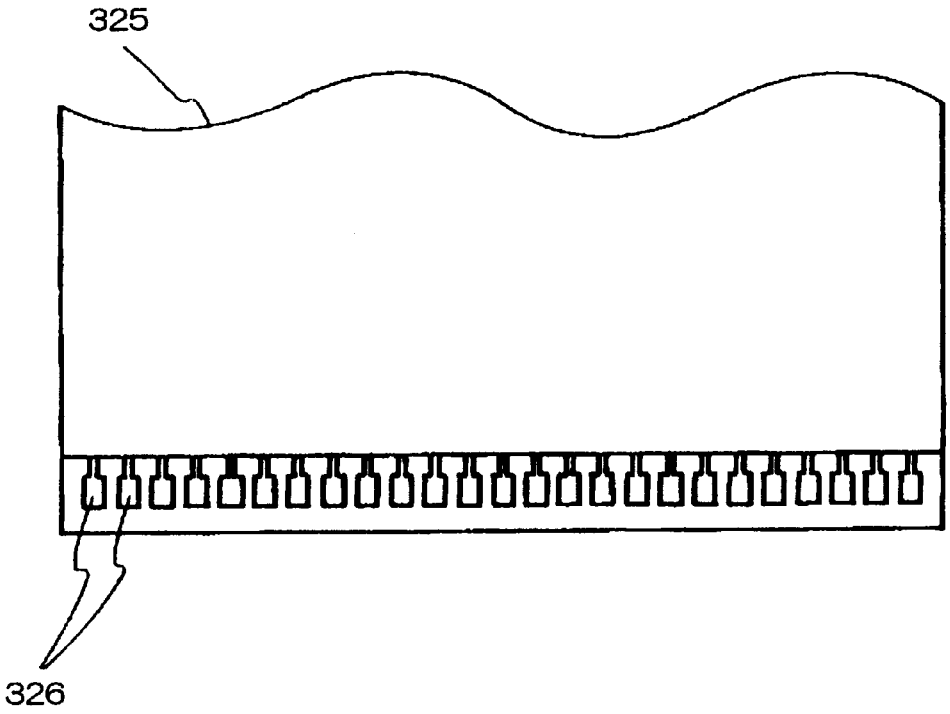
FIG. 9 is a plan view of a lower surface of a flexible substrate to be fixed onto a housing by means of the connector.

As illustrated in FIG. 9, the flexible substrate 325 is formed at a lower surface thereof with a plurality of pads 326 in series. The pads 326 make electrical contact with the contact portions 315, as illustrated in FIG. 8C, when the flexible substrate 325 is compressed onto the first flat plane 303 of the housing 302.

With reference to FIGS. 7A to 7C and FIGS. 8A to 8C, hereinbelow is explained a process of compressing and thus fixing the flexible substrate 325 in the connector 301.

First, the motion of the second outer surface 328 of the lever 320 is explained with reference to FIGS. 7A to 7C which are cross-sectional views taken along the line VII—VII in FIG. 4, that is, cross-sectional views of the second flat planes 304 of the housing 302 and the second outer surface 328. First, as illustrated in FIG. 7A, before the flexible substrate 325 is inserted into the connector 301, the lever 320 is made to stand upright. The first and second contact surfaces 328*a* and 328*b* do not make contact with the second flat plane 304 of the housing 302. With the lever 320 standing upright, the flexible substrate 325 is inserted into the connector 301, being slid onto the first flat plane 303.

Figure 7B:
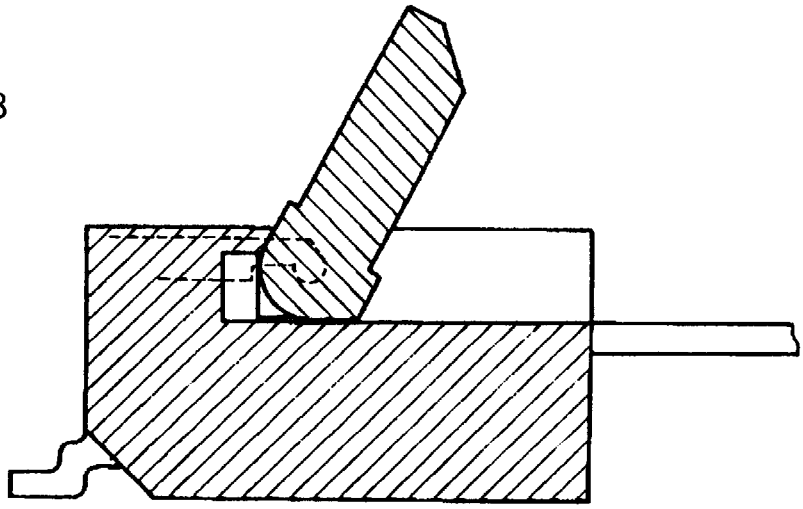
Figure 7C:
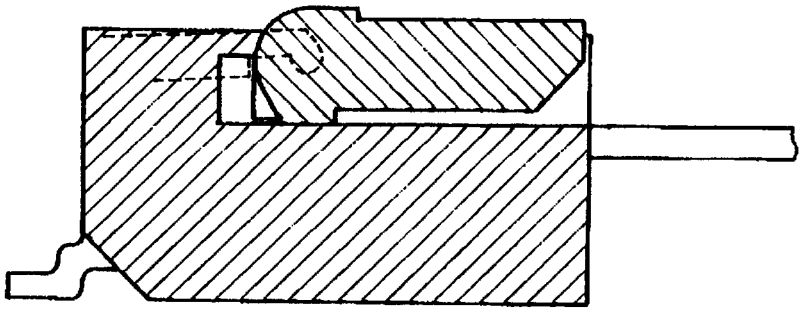

Then, as illustrated in FIG. 7B, the lever 320 starts to be rotated. As the lever 320 rotates, the first contact surface 328*a* first makes contact with the second flat plane 304. As a result, the support portions 314 of the contacts 310 are upwardly deformed. When the support portions 314 are upwardly deformed at maximum, the support portions 314 starts to return to their original position, namely, starts to be released.

As a result, the lever 320 is further rotated, and thus the second contact surface 328*b* makes contact with the second flat plane 304 when the lever 320 finishes its rotation, that is, when the flexible substrate 325 is compressed onto the first flat plane 303 by the lever 320, as illustrated in FIG. 7C.

Secondly, the motion of the first outer surface 327 of the lever 320 is explained with reference to FIGS. 8A to 8C which are cross-sectional views taken along the line VIII—VIII in FIG. 4, that is, cross-sectional views of the first flat plane 303 of the housing 302 and the first outer surface 327. First, as illustrated in FIG. 8A, before the flexible substrate 325 is inserted into the connector 301, the lever 320 is made to stand upright. The first, second and third contact surfaces 327*a*, 327*b* and 327*c* do not make contact with the flexible substrate 325. With the lever 320 standing upright, the flexible substrate 325 is inserted into the connector 301, being slid onto the first flat plane 303.

Then as illustrated in FIG. 8B, the lever 320 is made to rotate. The first contact surface 327*a* and then the third contact surface 327*c* make contact with the flexible substrate 325, as the lever 320 rotates.

Finally, the second contact surface 327*c* makes contact with the flexible substrate 325, when the lever 320 finishes its rotation, to thereby compress the flexible substrate 325 onto the first flat plane 303 of the housing 302. In this state, the support portions 314 of the contacts 310 are kept upwardly deformed, as illustrated in FIG. 8C.

If the connector 301 is viewed from a side thereof when the flexible substrate 325 is compressed onto the housing 302, the motion of the first and second outer surfaces 327 and 328 may be described as follows.

Before the lever 320 starts its rotation, a rotational center of the lever 320, a distal end of the first contact surface 327*a* of the first outer surface 327, and the contact portions 315 of the contacts 310 lie on a common line which is a vertical line, as illustrated in FIG. 8A.

Before the lever 320 starts its rotation, the first and second contact surfaces 328*a* and 328*b* of the second outer surface 328 is located outside the above-mentioned common line, as illustrated in FIG. 7A. The first contact surface 328*a* of the second outer surface 328 makes contact with the second flat plane 304 of the housing 302 almost when the first contact surface 328*a* passes over the above-mentioned common line, as illustrated in FIG. 7B. Finally, the first contact surface 328*a* is located inside the common line and the second contact surface 328*b* making contact with the second flat plane 304 is located perpendicular to the common line.

Figure 10A:
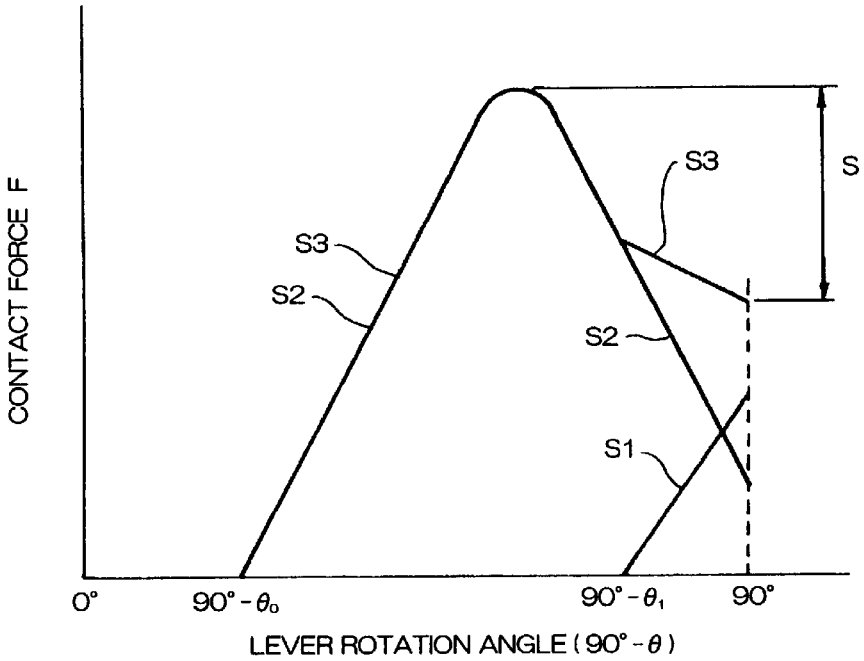
FIG. 10A is a graph showing a relation between a contact force and a rotation angle of a lever.
Figure 10B:
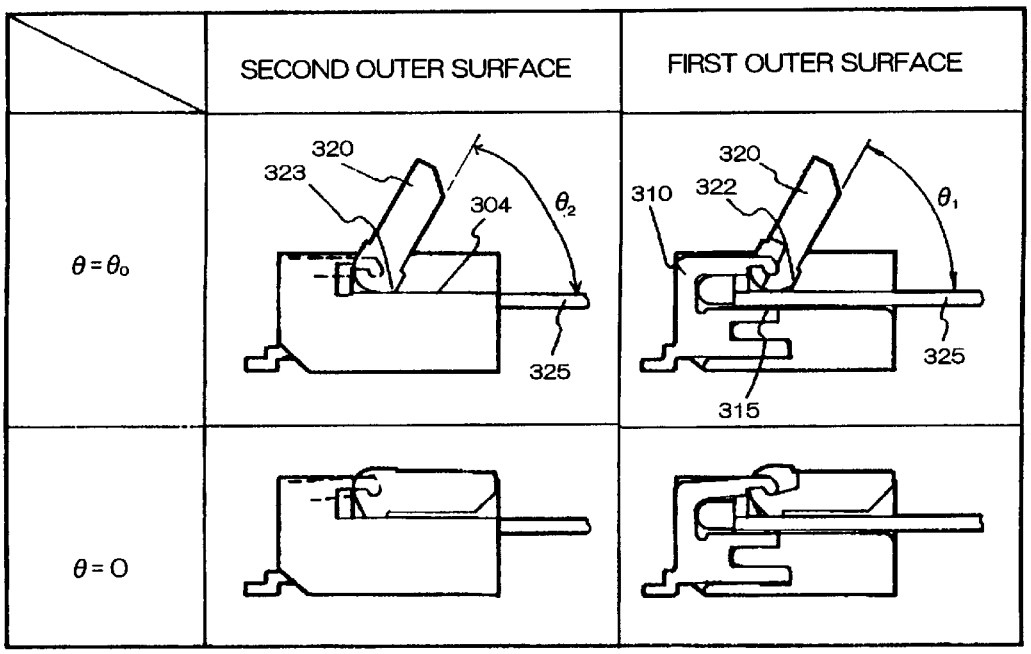
FIG. 10B is a table showing a relation between a contact force and a rotation angle of a lever.

Hereinbelow is explained a contact force generated by the lever 320 while the flexible substrate 325 is being compressed onto the first flat plane 303 of the housing 302 by the lever 320, with reference to FIGS. 10A and 10B. FIG. 10A illustrates a relation between a contact force F generated by the lever 320 and a lever angle ($90°-\theta$). Herein, an angle $\theta$ is defined as an angle formed between the lever 320 and a horizontal line, and hence the lever angle ($90°-\theta$) means an angle formed between the lever 320 and a vertical line. In FIG. 10A, a line S1 indicates a contact force F generated by the first outer surface 327 of the lever 320, a curve S2 indicates a contact force F generated by the second outer surface 328 of the lever 320, and a curve S3 indicates a sum of the contact forces generated by the first and second outer surfaces 327 and 328. FIG. 10B illustrates an angle $\theta_0$ at which the contact force F starts to be generated in the first and second outer surfaces 327 and 328, and also illustrates where the first and second outer surfaces 327 and 328 are positioned when the angle $\theta$ is equal to zero, that is, when the lever 320 finishes its rotation. As illustrated in FIG. 10B, the second outer surface 328 starts generating the contact force F when the angle θ is equal to $\theta_2$, and the first outer surface 327 starts generating the contact force F when the angle θ is equal to $\theta_1$.

In view of the curve S2 illustrated in FIG. 10A, the second outer surface 328 starts generating the contact force F when the second outer surface 328 starts making contact with the second flat plane 304. The contact force F increases as the lever 320 rotates, namely, the lever angle (90°−θ) increases. When the second outer surface 328 reaches a line connecting a rotational center of the lever 320 and the contact portions 315 of the contacts 310, the contact force F is maximized. Thereafter, the contact force F decreases as the lever 320 rotates. Even when the lever 320 finishes its rotation, namely, the lever angle (90°−θ) is equal to 90 degrees, the contact force F is not zero.

In view of the line S1 illustrated in FIG. 10A, the first outer surface 327 of the lever 320 approaches the flexible substrate 325 as the lever 320 rotates. However, the first outer surface 327 does not make contact with the flexible substrate 325 until the second outer surface 328 passes over the above-mentioned line. That is, as illustrated in FIG. 10B, the first outer surface 327 starts making contact with the flexible substrate 325, namely, generating the contact force F, when the lever angle (90°−θ) comes to equal to an angle ($90°-\theta_1$). Thereafter, the contact force F increases, as the lever 320 rotates. When the lever 320 finishes its rotation, namely, the lever angle (90°−θ) is equal to 90 degrees, the contact force F generated by the first outer surface 327 is at its maximum.

Thus, the contact force F generated totally by the lever 320 is considered a sum of the contact forces F generated by the first and second outer surfaces 327 and 328. Thus, there is obtained the curve S3 indicating the contact force F generated by the lever 320. Herein, the curve S3 is constituted of a combination of the curve S2 and the line S1. A self-locking force $S_L$ for keeping the flexible substrate 325 locked by the lever 320 is equal to a difference between a maximum force and a minimum force in the curve S3.

In the above-mentioned embodiment, the second flat plane 304 is formed at opposite ends of the contacts 310 arranged in series. However, it should be noted that at least one of the second flat planes may be formed between the adjacent contacts 310, and the first and second outer surfaces 327 and 328 of the lever 320 may be formed in association with the second flat planes in position.

Figure 11:
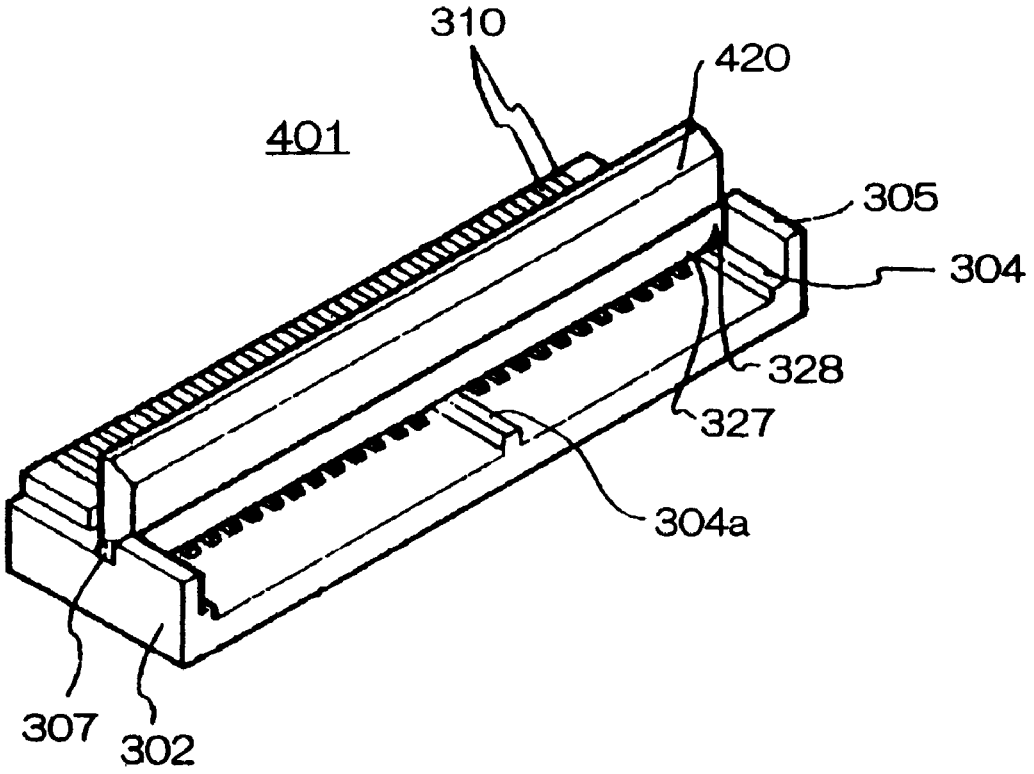
FIG. 11 is a perspective view of a connector in accordance with another preferred embodiment of the present invention.

FIG. 11 illustrates a connector 401 including an additional second flat plane 304*a* at the center of a row of the contacts 310 as well as the second flat planes 304 at the opposite ends of the row of the contacts 310. The additional second flat plane 304*a* has the same height and width as those of the second flat planes 304.

Figure 12:
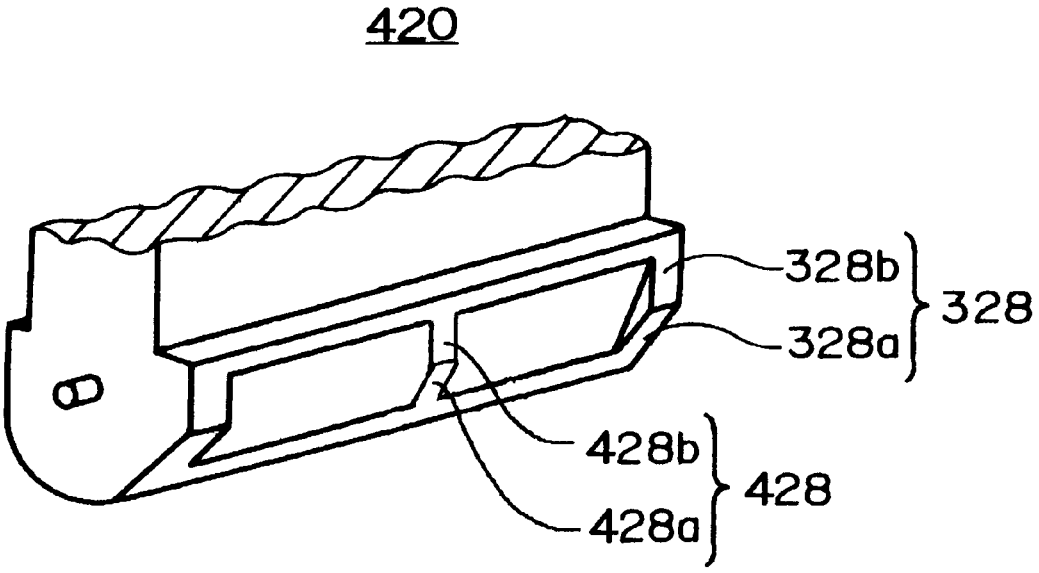
FIG. 12 is a partially enlarged perspective view of a lever to be used in the connector illustrated in FIG. 11.

FIG. 12 illustrates a lever 420 to be used in the connector 401. The lever 420 includes an additional second outer surface 428, as well as the second outer surfaces 328 at the opposite ends of the lever 420. The additional second outer surface 428 is identical in shape with the second outer surface 328. Namely, the additional second outer surface 428 is comprised of a first contact surface 428*a* and a second contact surface 428*b*. The additional second outer surface 428 is positioned so that it makes contact with the additional second flat plane 304*a*.

Since the connector 401 illustrated in FIG. 11 has a combination of the second outer surface and the second flat plane by the greater number than that of the connector 301 illustrated in FIG. 4, the connector 401 ensures a greater contact force than the contact force provided by the connector 301.

Though the connector 401 illustrated in FIG. 11 is designed to have one additional second flat plane 304*a* and the lever illustrated in FIG. 12 is designed to have one additional second outer surface 428 accordingly, it should be noted that the connector 401 may include two or more additional second flat planes 304*a,* in which case, the lever 420 is designed to have the same number of additional second outer surfaces 428*a,* 428*b,* 328*a,* 328*b* as the number of the additional second flat planes 304*a*. For instance, when the connector 401 is designed to have the additional second flat planes 304*a* by two or more, they may be equally spaced from one another.

As having been explained in connection with the preferred embodiment, the present invention provides advantages as follows. In accordance with the present invention, the contact force F is obtained by deforming the support portions of the contacts about which the lever is rotated. The lever is formed with the first and second outer surfaces. The first outer surface is designed to have a function of compressing the flexible substrate onto the contact portions of the contacts, and the second outer surface is designed to have a function of making contact with the second flat plane with a tight margin. Thus, the curve exhibiting a relation between the contact force F and the lever rotation angle (90°−θ), as illustrated in FIG. 10A, can be obtained only by the second outer surface of the lever and the second flat plane of the housing without using the flexible substrate.

In addition, the above-mentioned matter ensures the maximum contact force which the flexible substrate allows to receive can be generated when the lever finishes its rotation, that is, when the lever angle (90°−θ) comes to equal to 90 degrees. Even if the maximum contact force which the flexible substrate allows to receive is not intended to generate, an additional stress is not applied to the flexible substrate, which ensures that the repeat number by which the flexible substrate is inserted into the connector can be increased.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 9-139987 filed on May 29, 1997 including specification, claims, drawings and summary is incorporated herein by reference in its entirety.

What is claimed is:

1. A connector for connecting a flexible substrate to a plurality of contacts, comprising:

(a) a housing into which a flexible substrate is inserted;

(b) a plurality of contacts assembled to said housing; and (c) a lever rotatably supported above said housing, said lever being formed with a first outer surface and a second outer surface, said first outer surface being comprised at least of first and second contact surfaces where said first contact surface makes contact with said flexible substrate while said lever is rotating and said second contact surface makes contact with said flexible substrate when said lever finishes rotating for compressing said flexible substrate onto said housing, and said second outer surface making contact only with said housing for fixing said lever in a stationary position relative to said housing.

2. The connector as set forth in claim 1, wherein said second outer surface projects outwardly beyond said first outer surface.

3. The connector as set forth in claim 2, wherein said second outer surface is comprised at least of first and second contact surfaces where said first contact surface makes contact with said housing while said lever is rotating and said second contact surface makes contact with said housing when said lever finishes rotating.

4. A connector for connecting a flexible substrate to a plurality of contacts, comprising:

(a) a housing having a first plane on which a flexible substrate is supported and a second plane having a greater height than said first plane;

(b) a plurality of contacts assembled to said housing; and (c) a lever rotatably supported above said housing, said lever being formed with a first outer surface and a second outer surface, said first outer surface making contact only with said flexible substrate for compressing said flexible substrate onto said first plane, said second outer surface being comprised at least of first and second contact surfaces where said first contact surface makes contact with said second plane while said lever is rotating and said second contact surface makes contact with said second plane when said lever finishes rotating for fixing said lever in a stationary position relative to said housing.

5. The connector as set forth in claim 4, wherein a difference in height between said first and second planes is equal to a thickness of said flexible substrate.

6. The connector as set forth in claim 4, wherein said second outer surface projects outwardly beyond said first outer surface.

7. The connector as set forth in claim 6, wherein said first outer surface is comprised at least of first and second contact surfaces where said first contact surface makes contact with said flexible substrate while said lever is rotating and said second contact surface makes contact with said flexible substrate when said lever finishes rotating.

8. A connector for connecting a flexible substrate to a plurality of contacts, comprising:

(a) a housing having a first plane on which a flexible substrate is supported and second planes formed at opposite ends of said first plane and having a greater height than said first plane;

(b) a plurality of contacts assembled to said housing; and (c) a lever rotatably supported above said housing, said lever being formed with a first outer surface and second outer surfaces formed at opposite ends of said first outer surface, said first outer surface being comprised at least of first and second contact surfaces where said first contact surface makes contact with said flexible substrate while said lever is rotating and said second contact surface makes contact with said flexible substrate when said lever finishes rotating for compressing said flexible substrate onto said first plane, and said second outer surfaces making contact only with said second planes for fixing said lever in a stationary position relative to said housing.

9. The connector as set forth in claim 8, wherein a difference in height between said first and second planes is equal to a thickness of said flexible substrate.

10. The connector as set forth in claim 8, wherein said second outer surface projects outwardly beyond said first outer surface.

11. The connector as set forth in claim 10, wherein said second outer surface is comprised at least of first and second contact surfaces where said first contact surface makes contact with said second plane while said lever is rotating and said second contact surface makes contact with said second plane when said lever finishes rotating.

12. A connector for connecting a flexible substrate to a plurality of contacts, comprising:

(a) a housing having a first plane on which a flexible substrate is supported, second planes formed at opposite ends of said first plane, and at least one additional second plane located between said second planes, said second planes and said additional second plane all having a greater height than said first plane;

(b) a plurality of contacts assembled to said housing; and (c) a lever rotatably supported above said housing, said lever being formed with a first outer surface, second outer surfaces formed at opposite ends of said first outer surface, and at least one additional second outer surface between said second outer surfaces, said first outer surface making contact only with said flexible substrate for compressing said flexible substrate onto said first plane, said second outer surfaces making contact only with said second planes for fixing said lever in a stationary position relative to said housing, and said additional second outer surface making contact only with said additional second plane for fixing said lever in a stationary position relative to said housing.

13. The connector as set forth in claim 12, wherein said one additional second plane being substantially centered between said second planes.

14. The connector as set forth in claim 12, wherein said housing includes two or more additional second planes equally spaced from one another.

15. The connector as set forth in claim 12, wherein a difference in height between said first plane and said second plane and between said first plane and said additional second plane is equal to a thickness of said flexible substrate.

16. The connector as set forth in claim 12, wherein said second outer surface and said additional second outer surface project outwardly beyond said first outer surface.

17. The connector as set forth in claim 16, wherein said first outer surface is comprised at least of first and second contact surfaces where said first contact surface makes contact with said flexible substrate while said lever is rotating and said second contact surface makes contact with said flexible substrate when said lever finishes rotating.

18. The connector as set forth in claim 16, wherein said second outer surface is comprised at least of first and second contact surfaces where said first contact surface makes contact with said second plane while said lever is rotating and said second contact surface makes contact with said second plane when said lever finishes rotating, and wherein said additional second outer surface is comprised at least of additional first and second contact surfaces where said additional first contact surface makes contact with said additional second plane while said lever is rotating and said additional second contact surface makes contact with said additional second plane when said lever finishes rotating.

19. A connector for connecting a flexible substrate to a plurality of contacts, comprising:

(a) a housing into which a flexible substrate is inserted;

(b) a plurality of contacts assembled to said housing; and (c) a lever rotatably supported above said housing, said lever being formed with a first outer surface and a second outer surface, said first outer surface being comprised at least of first and second contact surfaces where said first contact surface makes contact with said flexible substrate while said lever is rotating and said second contact surface makes contact with said flexible substrate when said lever finishes rotating, said second outer surface being comprised at least of first and second contact surfaces where said first contact surface makes contact with said housing while said lever is rotating and said second contact surface makes contact with said housing when said lever finishes rotating.

20. The connector as set forth in claim 19, wherein said second outer surface projects outwardly beyond said first outer surface.

21. A connector for connecting a flexible substrate to a plurality of contacts, comprising:

(a) a housing having a first plane on which a flexible substrate is supported and a second plane having a greater height than said first plane;

(b) a plurality of contacts assembled to said housing; and (c) a lever rotatably supported above said housing, said lever being formed with a first outer surface and a second outer surface, said first outer surface being comprised at least of first and second contact surfaces where said first contact surface makes contact with said flexible substrate while said lever is rotating and said second contact surface makes contact with said flexible substrate when said lever finishes rotating, said second outer surface being comprised at least of first and second contact surfaces where said first contact surface makes contact with said second plane while said lever is rotating and said second contact surface makes contact with said second plane when said lever finishes rotating.

22. The connector as set forth in claim 21, wherein a difference in height between said first and second planes is equal to a thickness of said flexible substrate.

23. The connector as set forth in claim 21, wherein said second outer surface projects outwardly beyond said first outer surface.

24. A connector for connecting a flexible substrate to a plurality of contacts, comprising:

(a) a housing having a first plane on which a flexible substrate is supported and second planes formed at opposite ends of said first plane and having a greater height than said first plane;

(b) a plurality of contacts assembled to said housing; and (c) a lever rotatably supported above said housing, said lever being formed with a first outer surface and second outer surfaces formed at opposite ends of said first outer surface, said first outer surface being comprised at least of first and second contact surfaces where said first contact surface makes contact with said flexible substrate while said lever is rotating and said second contact surface makes contact with said flexible substrate when said lever finishes rotating, said second outer surface being comprised at least of first and second contact surfaces where said first contact surface makes contact with said second plane while said lever is rotating and said second contact surface makes contact with said second plane when said lever finishes rotating.

25. The connector as set forth in claim 24, wherein a difference in height between said first and second planes is equal to a thickness of said flexible substrate.

26. The connector as set forth in claim 24, wherein said second outer surface projects outwardly beyond said first outer surface.

27. A connector for connecting a flexible substrate to a plurality of contacts, comprising:

(a) a housing having a first plane on which a flexible substrate is supported, second planes formed at opposite ends of said first plane, and at least one additional second plane located between said second planes, said second planes and said additional second plane all having a greater height than said first plane;

(b) a plurality of contacts assembled to said housing; and (c) a lever rotatably supported, about a rotational center, above said housing, said lever being formed with a first outer surface, second outer surfaces formed at opposite ends of said first outer surface, and at least one additional second outer surface between said second outer surfaces, wherein when said lever is rotated in a first position normal to said first plane of said housing, said first outer surface, said contacts and said rotational center of said lever all lie in a common plane, while said second outer surface and said additional second outer surface are located outside said common plane before said lever starts its rotation, said second outer surface making contact with said second plane about when said second outer surface passes over said common plane, said additional second outer surface making contact with said additional second plane about when said additional second outer surface passes over said common plane, said second outer surface and said additional second outer surface being located inside said common plane after said flexible substrate is supported on said first plane.

28. The connector as set forth in claim 27, wherein said additional second plane being located at the center between said second planes.

29. The connector as set forth in claim 27, wherein said housing include two or more additional second planes equally spaced from one another.

30. The connector as set forth in claim 27, wherein a difference in height between said first plane and said second plane, and between said first plane and said additional second plane is equal to a thickness of said flexible substrate.

31. The connector as set forth in claim 27, wherein said second outer surface and said additional second outer surface project outwardly beyond said first outer surface.

32. The connector as set forth in claim 31, wherein said first outer surface is comprised at least of first and second contact surfaces where said first contact surface makes contact with said flexible substrate while said lever is rotating and said second contact surface makes contact with said flexible substrate when said lever finishes rotating.

33. The connector as set forth in claim 31, wherein said second outer surface is comprised at least of first and second contact surfaces where said first contact surface makes contact with said second plane while said lever is rotating and said second contact surface makes contact with said second plane when said lever finishes rotating, and wherein said additional second outer surface is comprised at least of additional first and second contact surfaces where said additional first contact surface makes contact with said additional second plane while said lever is rotating and said additional second contact surface makes contact with said additional second plane when said lever finishes rotating.

* * * * *